US008328032B2

(12) United States Patent
Gong

(10) Patent No.: US 8,328,032 B2
(45) Date of Patent: Dec. 11, 2012

(54) SELF-MIXING CONTAINER WITH A RELEASABLE INTERNAL VESSEL AND ITS USAGE

(76) Inventor: Xiao Gong, Jiangxi (CN)

( * ) Notice: Subject to any disclaimer, the term of this patent is extended or adjusted under 35 U.S.C. 154(b) by 852 days.

(21) Appl. No.: 12/160,294

(22) PCT Filed: Jan. 16, 2007

(86) PCT No.: PCT/CN2007/000158

§ 371 (c)(1),
(2), (4) Date: Dec. 11, 2008

(87) PCT Pub. No.: WO2007/082464
PCT Pub. Date: Jul. 26, 2007

(65) Prior Publication Data

US 2009/0180923 A1 Jul. 16, 2009

(30) Foreign Application Priority Data

Jan. 17, 2006 (CN) ..... 2006 2 0095128
May 17, 2006 (CN) ..... 2006 2 0096721
Aug. 16, 2006 (CN) ..... 2006 2 0098537

(51) Int. Cl.
*B65D 47/00* (2006.01)

(52) U.S. Cl. ..... 215/227; 215/DIG. 8; 206/219

(58) Field of Classification Search ..... 220/23.89, 220/522, 521; 215/DIG. 8, 227, 258; 206/219, 206/221, 222, 568
See application file for complete search history.

(56) References Cited

U.S. PATENT DOCUMENTS 4,132,308 A * 1/1979 Goncalves ..... 206/219
4,386,696 A * 6/1983 Goncalves ..... 206/221
4,618,444 A * 10/1986 Hudson et al. ..... 8/111
4,903,828 A * 2/1990 Finke et al. ..... 206/221
6,047,818 A * 4/2000 Warby et al. ..... 206/221

FOREIGN PATENT DOCUMENTS

| | | |
|---|---|---|
| CN | 2619926 | 6/2004 |
| EP | 0190593 | 8/1986 |
| EP | 1975080 | 11/2010 |
| GB | 2298406 | 9/1996 |
| JP | 10-273161 | 10/1998 |
| JP | 2000-95278 | 4/2000 |
| JP | 2004-323097 | 11/2004 |
| JP | 2004-352302 | 12/2004 |
| WO | WO 2006004345 | 1/2006 |

OTHER PUBLICATIONS

Jul. 10, 2009, EPO Office Action for Application 07 702.090.7-2308.
Oct. 21, 2010, Decision to Grant EP Application 07 702.090.7-2308, now EP 1975080.
Mar. 18, 2009, Supplementary European Search Report EP 07702090.
ISR of PCT/CN2007/000158.

* cited by examiner

*Primary Examiner* — Anthony Stashick
*Assistant Examiner* — Jeffrey Allen
(74) *Attorney, Agent, or Firm* — Neifeld IP Law, PC

(57) ABSTRACT

A self-mixing container with a releasable internal vessel and its usage, comprising a container body, a double-walled external cap and an internal vessel. This container makes it possible to pack and seal in a cold filling process at least two different materials in one and the same container body respectively. When in use, at least two kinds of materials are mixed and formulated in one and the same container body in a rapid and automatic way, by means of relative movement of the screw-threads by which the container body, the double-walled external cap and the internal vessel are coupled with each other, and engagement of the ratchet and the pawls, without the structure of the container body being damaged, so that initial fresh active components in the materials sealed therein are preserved, and rapid formulation is achieved.

14 Claims, 11 Drawing Sheets

SELF-MIXING CONTAINER WITH A RELEASABLE INTERNAL VESSEL AND ITS USAGE

This is a PCT US national stage application of PCT/CN2007/000158 filed Jan. 16, 2007, published Jul. 26, 2007 as 2007/082464, which claims Paris convention priorities to CN 200620095128.1 filed Jan. 17, 2006, CN 200620096721.8 filed May 17, 2006, and CN 200620098537.7 filed Aug. 16, 2006.

TECHNICAL FIELD

The present invention relates to a self-mixing container with a releasable internal vessel, in which container at least two kinds of contents can be mixed with each other, especially liquid with liquid, liquid with solid, or solid with solid contents, and usage of the self-mixing container with a releasable internal vessel. In other words, at least two kinds of materials are packed in one and the same container in which speedy mixing and formulating of said at least two kinds of materials can be realized, without the structure of the container body being damaged in use.

TECHNICAL BACKGROUND

Packing products in a container or vessel is a conventional packing technology. However, only one kind of material can be contained in one ordinary packing container. For more than one kind of materials, separate packing is necessary. When used in a mixed state, materials can only be mixed outside packing containers. Therefore, at least two containers must be used, resulting in inconvenience in using many products to be rapidly and on-site formulated, such as pharmaceuticals, chemicals, food and beverage, disinfectants, strong detergents, farm chemicals, etc. Accordingly, aiming at disadvantages of the containers of prior art, the present inventor has, after studying with great effort, invented a container comprising a packing container body in which at least two kinds of materials can be contained and sealed separately, wherein said at least two kinds of materials separately sealed and contained in said packing container body will be mixed and formulated in a speedy and automatic way, without the container body structure being damaged in use.

External cap sealing-offs of the self-mixing container with a releasable internal vessel according to the invention are spiral mechanical cold sealing-offs, hereunder simply referred as cold sealing-off. Compared with heat seal binding (sealing-off) disclosed in the patent ZL200520051109.4 with the publication No. CN2805767Y and the title of invention "Large infusion multiple-chamber bag with solid pharmaceutical chamber capable of shielding lights and preventing oxygen permeation for filling liquid and solid pharmaceuticals", advantages of the present invention reside in that a cold sealing-off is executed at room temperature or low temperature so as to remain fully initial and fresh active components in filled materials. In contrast, a heat seal binding (sealing-off) in the above-mentioned patent needs to be executed at a high temperature, and thus it could affect fresh active components in filled materials near the sealing-off.

Regarding a self-mixing method with a diaphragm being broken as disclosed in a Chinese patent ZL93241475.3 (Publication No. CN2191839Y, and the title of invention "Two stage type extruded lid of raw material") and a self-mixing method by piercing an aluminum foil as disclosed in a Chinese patent 95244597.2 (Publication No. CN2249214Y, and the title of invention "Reagent preserver and adder"), they both need to break or pierce an element, resulting in a possibility of introducing particles into containers due to the broken element. The self-mixing container with a releasable internal vessel according to this invention is characterized in that self-mixing is realized by rotating an external cap to cause the internal vessel to release and drop into the container, without breaking all the elements of the container body. So, there would be no risk of particles (different materials) dropping into the container due to the broken elements, ensuring the purity of the materials packed in the self-mixing container body.

SUMMARY OF THE INVENTION

The container according to the present invention comprises a container body, an external cap and an internal vessel. The external cap includes double walls, i.e. a cap inner wall and a cap outer wall. An inner surface of the cap inner wall and an inner surface of the cap outer wall are both provided with screw-threads, wherein the screw-thread on the inner surface of the cap outer wall can be engaged with a screw-thread provided on an outer surface of a container body mouth. The screw-thread on the inner surface of the cap inner wall can be engaged with a screw-thread provided on an outer wall of the internal vessel. A ratchet is arranged below the screw-thread on the outer wall of the internal vessel, and pawls are arranged in a position corresponding to the ratchet on the inner wall of the container body mouth. In addition, the cap inner wall is provided with an inner oblique surface at its lower end, and an outer oblique surface is arranged in a correspondent position on the internal vessel.

During assemble, after the external cap and the internal vessel are abutted or coupled with each other through screw-thread or bayonet, an assembly formed by the combined external cap and the internal vessel will be inserted into the container body, and then the external cap will be tightened by rotating. At this moment, the external cap and the internal vessel will be coupled tightly with the container body, with the inner oblique surface on the cap inner wall abutting against the outer oblique surface on the outer wall of the internal vessel, and the ratchet of the internal vessel being tightly engaged with the pawls on inner wall of the container body mouth simultaneously. So assembling of the whole self-mixing container with a releasable internal vessel is finished.

When in use, the external cap is rotated to unscrew, but the internal vessel is prevented from rotating with the external cap due to a tight engagement of the ratchet with the pawls, until the external cap finishes the screw-thread route on the container body mouth with the internal vessel and the cap inner wall finishing the screw-thread route therebetween at the same time. At this moment, the internal vessel is released from the external cap, so that the internal vessel drops into the container body via gravity, resulting in automatic mixing of at least two kinds of materials in the container body.

The container body and the cap outer wall of said self-mixing container with a releasable internal vessel according to the invention are abutted against each other and coupled by screw-thread or bayonet.

The upper portion of the internal vessel and the cap inner wall of said self-mixing container with a releasable internal vessel according to the invention are coupled with each other by screw-thread or bayonet.

The external cap of said self-mixing container with a releasable internal vessel according to the invention can be located at any position on said container body.

The self-mixing container with a releasable internal vessel according to the invention can be provided with one or more external caps and internal vessels.

The configuration or shape of said self-mixing container with a releasable internal vessel according to the invention or its internal vessel can be designed freely.

Said self-mixing container with a releasable internal vessel according to this invention is an ideal self-mixing packing container, because abutting and coupling of the container body, the external cap and the internal vessel by means of screw-thread or bayonet are realized, so that different materials such as liquid and liquid, liquid and solid, or solid and solid materials can be separately sealed and contained in one container, and self-mixing can be completed within the container quickly. The self-mixing container according to this invention is simple in its structure and fabrication, durable and low cost, especially convenient for carrying on and using.

In the self-mixing container with a releasable internal vessel according to this invention, because at least two kinds of materials are separately sealed and contained in one container, it is ensured active components in said at least two kinds of materials in the container body would not be degraded before they are rapidly formulated in use.

Due to the above characteristic features, the self-mixing container with a releasable internal vessel according to this invention is particularly suitable for packing products comprising at least two kinds of materials to be rapidly formulated and on-site activated in technical fields of pharmaceuticals, food and beverage, chemicals, farm chemicals, disinfectants and fire-fighting equipments.

Due to the above characteristic features, the self-mixing container with a releasable internal vessel according to this invention could be used as a platform for new products, so that more and more new types of products to be rapidly formulated and on-site activated could be developed and prepared in technical fields of pharmaceuticals, food and beverage, chemicals, farm chemicals, disinfectants and fire-fighting equipments.

DESCRIPTION OF THE PREFERRED EMBODIMENTS

Figure 1:
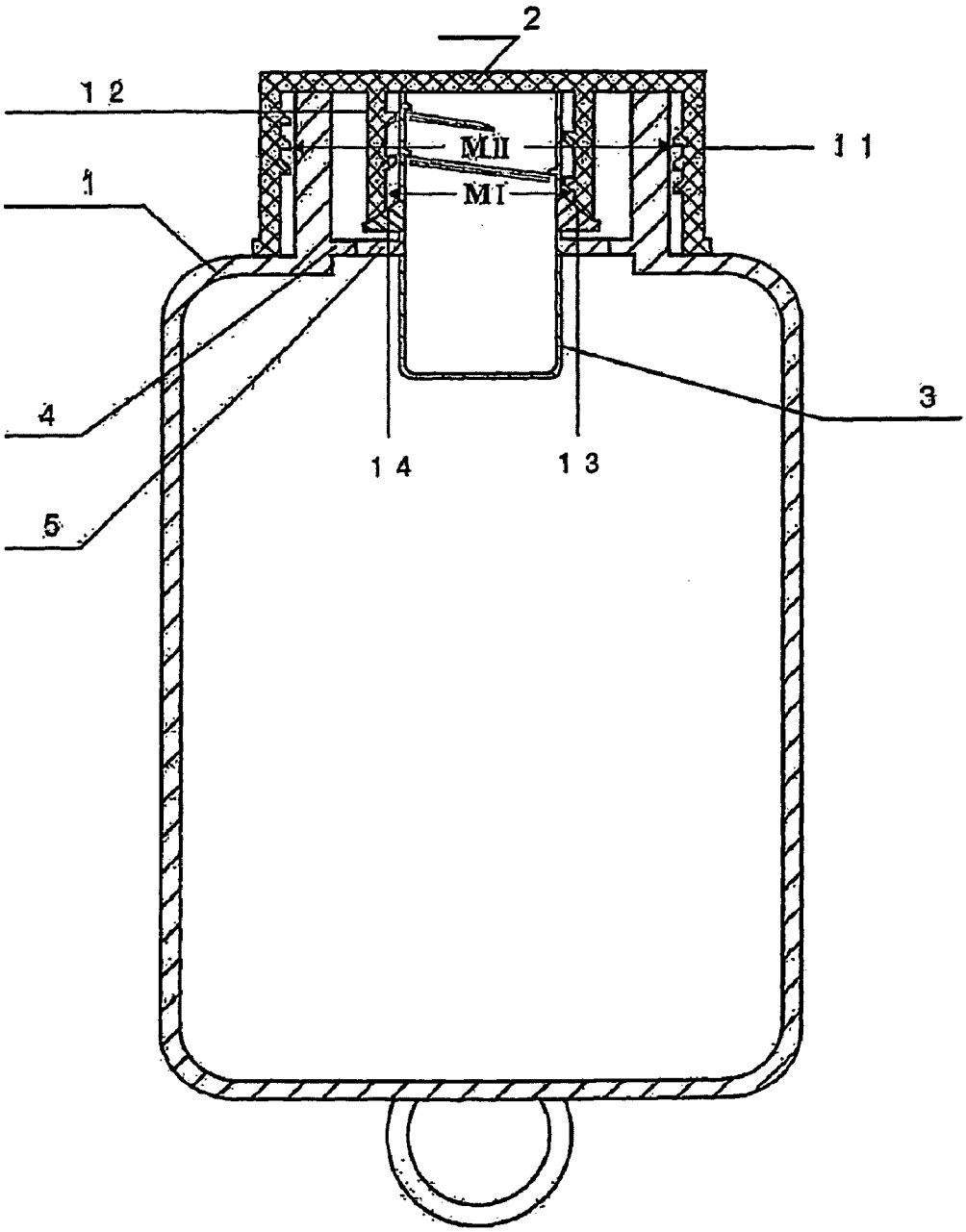
FIG. 1 is a schematic view showing the structure of a self-mixing container with a releasable internal vessel.

A self-mixing container with a releasable internal vessel according to this present invention comprises a container body 1, an external cap 2 and an internal vessel 3. The external cap 2 is formed with double walls, i.e. a cap inner wall 12 and a cap outer wall 11. The internal vessel 3 is connected with the external cap 2 via screw-threads MI provided on an upper portion of the internal vessel 3 and on the cap inner wall 12. A ratchet 5 is arranged below the screw-thread on an outer wall of the internal vessel 3, and pawls 4 are arranged in a position corresponding to the ratchet 5 on an inner wall of a mouth-neck portion of the container body 1. A screw-thread MII is formed on an outer surface of the container mouth, so that the container body 1 is abutted tightly and engaged with the cap outer wall 11 of the external cap 2, and the internal vessel 3 is abutted tightly and engaged with the cap inner wall 12 of the external cap 2 through the screw-threads MI and MII, respectively. An inner oblique surface 13 is formed on a lower end of the cap inner wall 12, and an outer oblique surface 14 is formed in a corresponding position on the internal vessel 3. When the cap inner wall 12 is abutted tightly and engaged with the internal vessel 3 by the screw-thread MI, the inner oblique surface 13 is abutted tightly against the outer oblique surface 14, so that the sealing performance is enhanced.

During assemble, after the external cap 2 and the internal vessel 3 are abutted and connected with each other through the screw-thread, the assembly formed by the external cap 2 and the internal vessel 3 will be inserted into the container body 1. Subsequently, the external cap will be screwed on, with the assembly of the external cap 2 and the internal vessel 3 being tightly engaged with the container body 1. In this case, the inner oblique surface 13 on the cap inner wall 12 is abutted tightly against the outer oblique surface 14 on the outer wall of the internal vessel, along with the ratchet 5 of the internal vessel 3 being engaged tightly with the pawls 4 on the inner wall of the container body mouth. As a result, assemble of the whole self-mixing container with a releasable internal vessel is completed.

When in use, the external cap 2 is unscrewed, but the internal vessel 3 is prevented from rotating with the external cap 2 as the ratchet 5 and the pawls 4 are engaged. When the external cap 2 passes the stroke of the screw-thread MI on the container body mouth, the internal vessel 3 and the cap inner wall 12 pass the stroke of the screw-thread MI therebetween at the same time. At this moment, the internal vessel 3 is released from the external cap 2, and drops into the container body 1 via gravity, so that automatic mixing of at least two kinds of materials in the container body 1 will be realized.

The ratchet 5 and the pawls 4 can be formed freely with any shape, if the tight engagement or contact will not be influenced, and the container body 1, the external cap 2 and the internal vessel 3 can be formed into any shape.

The invention will be described hereunder in detail with reference to embodiments.

Embodiment 1

This embodiment relates to the usage of a self-mixing container with a releasable internal vessel in pharmaceutical field. (c.f. FIG. 1, FIG. 2, FIG. 3 and FIG. 4)

Figure 2:
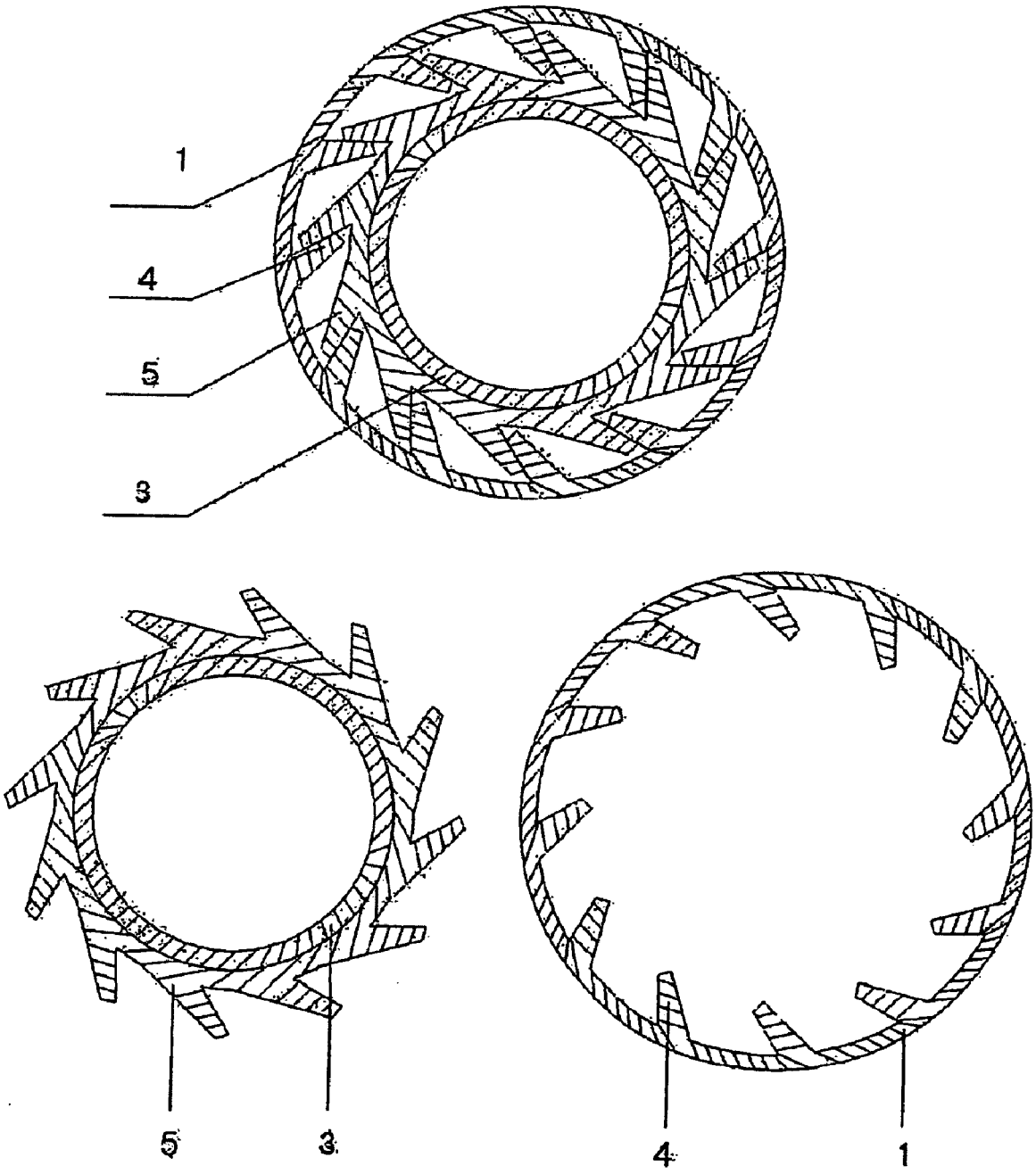
FIG. 2 is a schematic view showing the assembled structure of a ratchet 5 and pawls 4 of a self-mixing container with a releasable internal vessel.
Figure 3:
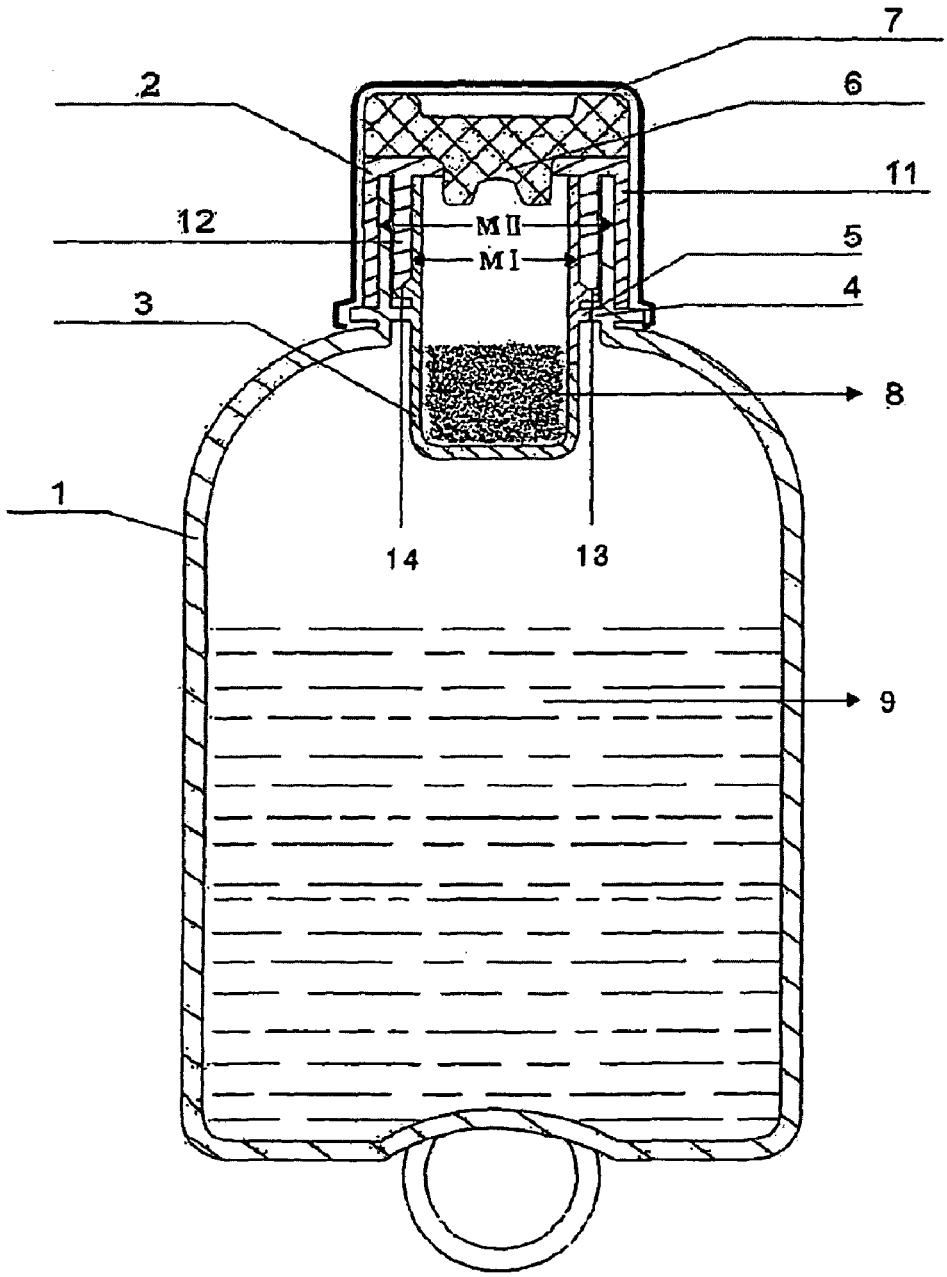
FIG. 3 is a schematic view showing the structure of a self-mixing container with a releasable internal vessel used for separately packing a sterile powder and a large volume liquid for infusion, wherein one releasable internal vessel is integrated in one self-mixing container.

In this case, a self-mixing container with a releasable internal vessel comprises a container body 1, an external cap 2 and an internal vessel 3. The top central portion of said external cap 2 is hollow. The upper portion of the internal vessel 3 is abutted tightly and connected with the cap inner wall 12 of the external cap 2 via screw-thread MI. The cap outer wall 11 of the external cap 2 is abutted tightly and connected with the container body 1 with screw-thread MII, see. FIG. 3. A ratchet 5 is provided at a position below the screw-thread on the outer wall of the internal vessel 3, and pawls 4 are provided in a position corresponding to the ratchet 5 on the inner wall of the mouth-neck portion of the container body, see FIG. 2. An inner oblique surface 13 is formed on the lower end of the cap inner wall 12, and an outer oblique surface 14 is formed in a corresponding position on the internal vessel 3. When the cap inner wall 12 is abutted tightly and coupled with the internal vessel 3 via screw-thread ML, the inner oblique surface 13 will be abutted tightly against the outer oblique surface 14 so as to enhance the sealing performance, see FIG. 3. The top central position of the external cap 2 is sealed by a rubber stopper 6. The assembly formed by the external cap 2 and the internal vessel 3 is packed and sealed from outside using foils 7, plastics or other materials.

The container body 1 is formed as a cylindrical bottle made of polypropylene, metal or glass materials, while the external cap 2 is a round cap of plastics and the internal vessel 3 is a cylindrical bottle of polypropylene. The operating principle of the embodiment will be explained as follows: a large volume liquid for infusion, generally a large volume water, a large volume glucose solution, a large volume sodium chloride solution or a large volume glucose and sodium chloride mixed solution (hereunder simply referred as a large volume infusion liquid 9), is filled into the container body. Another kind of pharmaceutical is filled in the internal vessel 3. In this embodiment, the pharmaceutical is a sterile powder 8. When in use, the foil 7 will be peeled off and the external cap 2 will be unscrewed. Because the pawls 4 on the inner wall of the container body mouth are engaged with the ratchet 5 on the outer wall of the internal vessel 3, so that the internal vessel 3 is prevented from rotating with the external cap 2, resulting in the separation of the internal vessel 3 from the external cap 2, the internal vessel 3 drops into the container body 1 via gravity. At this moment, the external cap is screwed on again and then the container body 1 is swung, resulting in complete mixing of a large volume infusion liquid 9 with the sterile powder 8. In this technical solution, it is achieved that a large volume infusion liquid 9 and the sterile pharmaceutical powder 8 are packed in the container body 1 and the internal vessel 3 separately during production, transport and storage. However, the contents in the container body 1 and the internal vessel 3 will be mixed speedily and automatically right before use.

Figure 4:
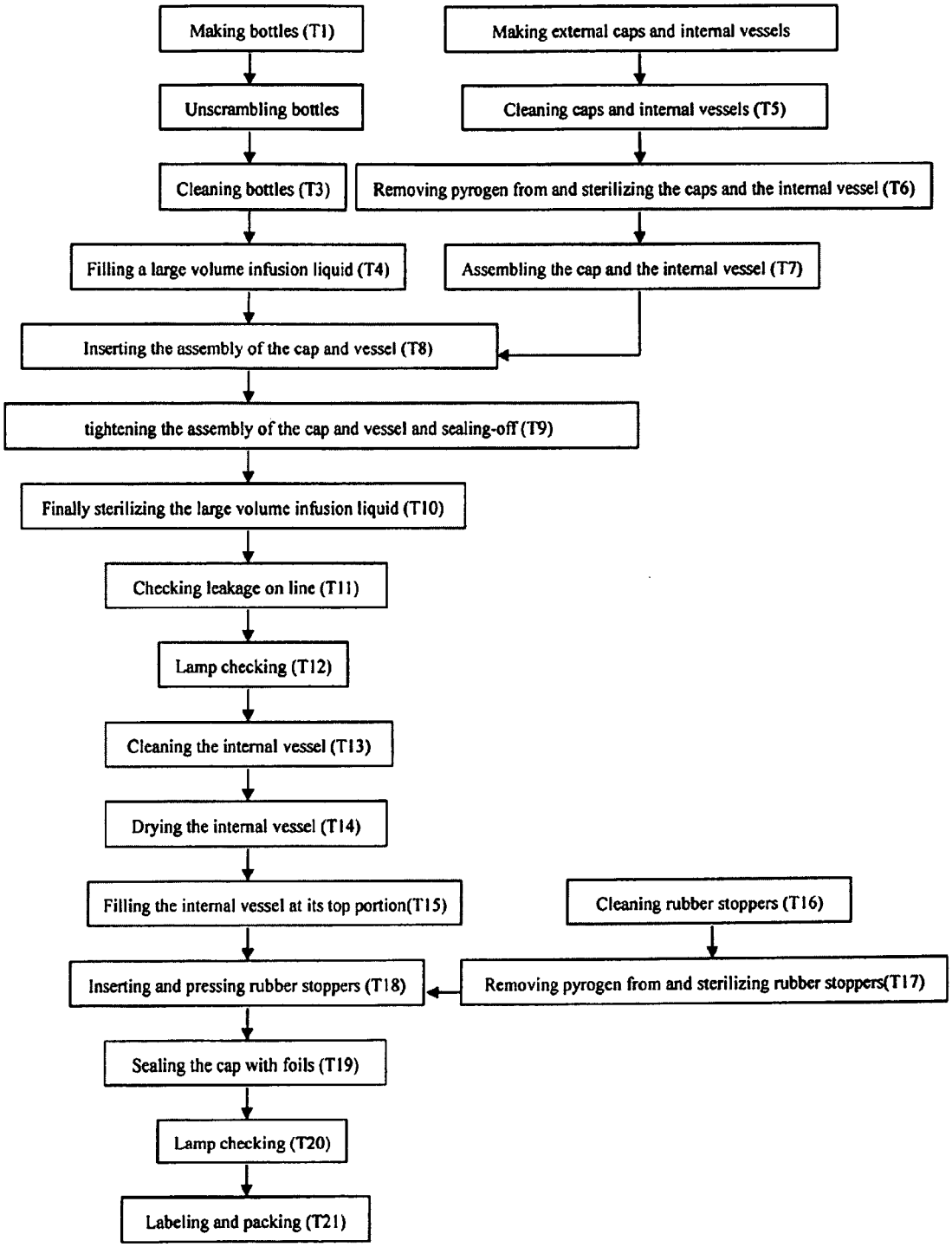
FIG. 4 shows an industrial automatic filling process for a self-mixing container with a releasable internal vessel in pharmaceutical field (a sterile powder and a large volume liquid for infusion or a sterile liquid and a large volume liquid for infusion in a self-mixing container).

For a self-mixing container with a releasable internal vessel to be used in pharmaceutical field, a corresponding industrial automatic filling production line is described with reference to FIG. 4 as follows: said process line comprises: making bottles T1, unscrambling bottles T2, cleaning bottles T3, filling a large volume infusion liquid T4, cleaning caps and internal vessels T5, sterilizing the caps and the internal vessels T6, assembling the caps and the internal vessels T7, inserting the assembly of the cap and the internal vessel T8, screwing on the assembly of the cap and the internal vessel and sealing-off T9, sterilizing a large volume infusion liquid T10, checking leakage on line T11, lamp checking T12, cleaning internal vessels T13, drying internal vessels T14, filling internal vessels T15, cleaning rubber stoppers T16, sterilizing the rubber stoppers T17, inserting and pressing the rubber stoppers T18, sealing the cap with a foil T19, lamp checking T20, labeling and packing T21, etc. It is characterized in that:

1. Firstly, a large volume infusion liquid 9 is filled and then the final sterilizing is performed (executed by T1-T12), then a sterile pharmaceutical is filled and sealed (executed by T13-T21). Filling a large volume infusion liquid T9 and filling and sealing a sterile pharmaceutical can be performed in a combined production line, and the large volume infusion liquid and sterile pharmaceutical are filled into one and the same container body, so that separate sealing and packing the large volume infusion liquid 9 and another sterile pharmaceutical are realized.
2. This production process meets requirements of a large volume infusion production process and a sterile pharmaceutical production process at the same time. The final sterilizing process is a general large volume infusion sterilizing process, and the sterile pharmaceutical filling process is also a general sterile pharmaceutical filling process.
3. The sealing-off T9 of the large volume infusion liquid 9 is carried out separately from the sealing-off T18 of the sterile pharmaceutical, i.e. they are two sealing-offs after different pharmaceutical fillings respectively.
4. After the large volume infusion liquid 9 and the sterile pharmaceutical powder 8 have been filled according to the above-mentioned procedure, the external cap is packed and sealed finally from the outside using a foil 7, plastics or other materials, with weaken points or lines being provided for easy tearing or destroying the package in use to open the cap for executing mixing of the sterile powder 8 and the large volume infusion liquid 9.
5. The vacuum lyophilization technology is adopted to dry the internal vessel T14 on line, in order to ensure meeting the water content standard and storage requirements of the sterile powder.

Embodiment 2

Figure 5:
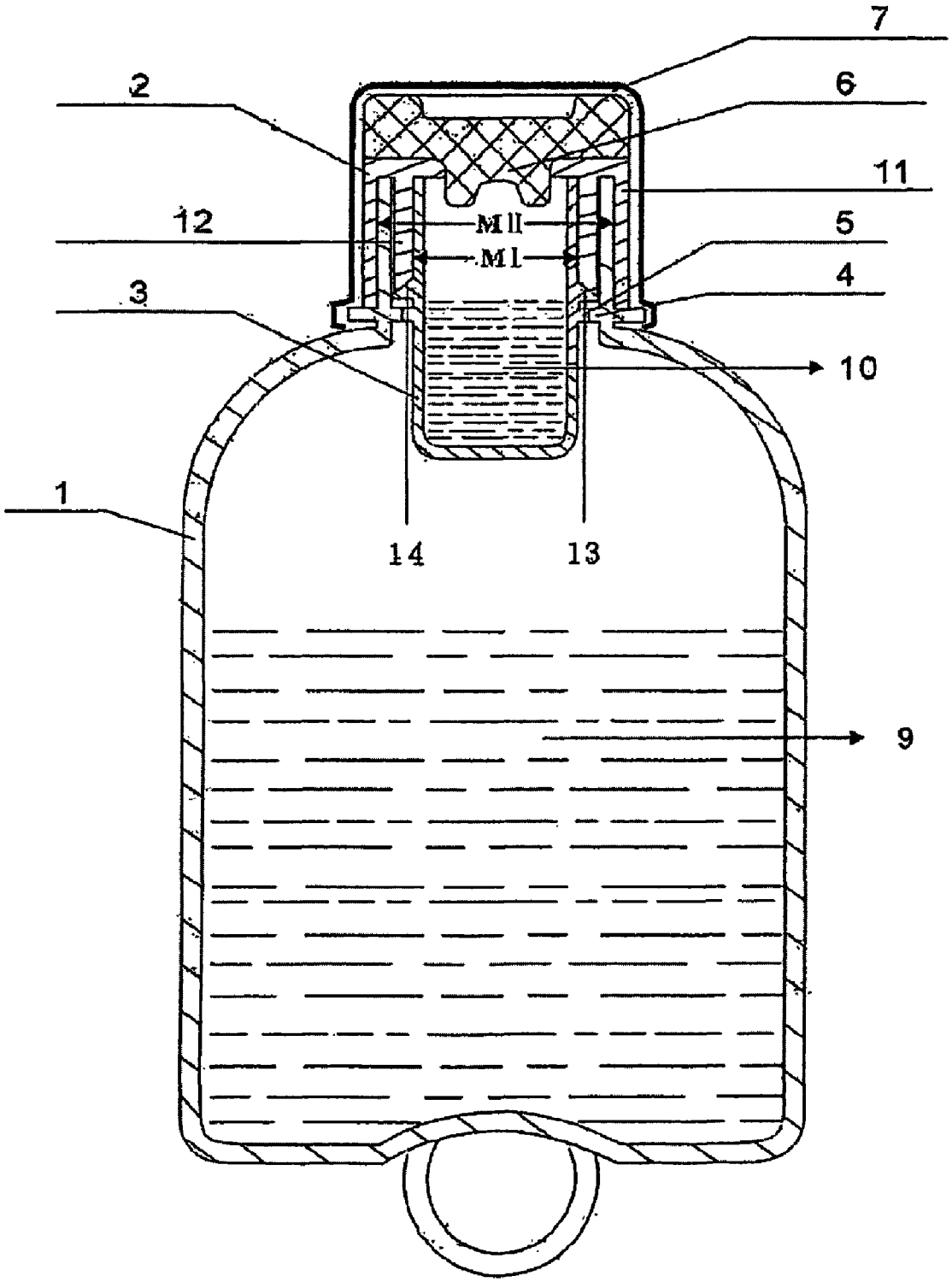
FIG. 5 is a schematic view showing the structure of a self-mixing container with a releasable internal vessel used for separately packing a sterile liquid and a large volume liquid for infusion, wherein a sterile liquid pharmaceutical is contained in said internal vessel.

This embodiment relates to the usage of a self-mixing container with a releasable internal vessel in pharmaceutical field. (c.f. FIG. 3, FIG. 4 and FIG. 5)

A difference between this embodiment and Embodiment 1 resides in that a sterile pharmaceutical liquid 10 is filled into the internal vessel 3.

A difference between two corresponding industrial automatic filling production lines used in pharmaceutical field is as follows: sterilized heated-air technology is carried out on line in the step of drying the internal vessel T14, with quality requirements concerning the sterile pharmaceutical liquid 10 being met.

Embodiment 3

Figure 6:
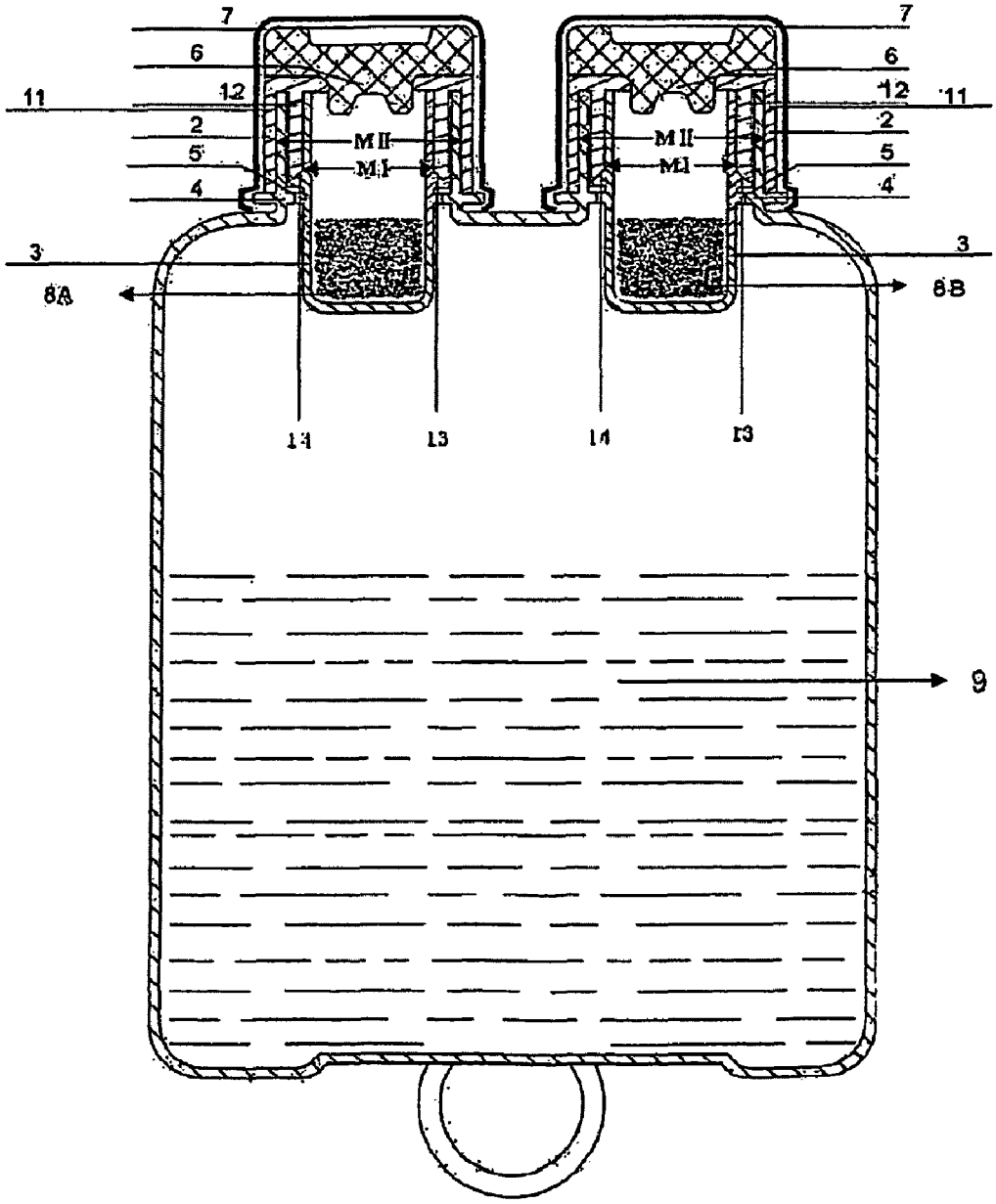
FIG. 6 is a schematic view showing the structure of a self-mixing container with a releasable internal vessel used for separately packing two sterile powders and a large volume liquid for infusion, wherein two releasable internal vessels are integrated in one self-mixing container.

This embodiment relates to the usage of a self-mixing container with a releasable internal vessel in pharmaceutical field. (c.f. FIG. 3, FIG. 4 and FIG. 6)

A difference between this embodiment and Embodiment 1 resides in that the self-mixing container with a releasable internal vessel comprises a container body 1 and two external caps 2, wherein two internal vessels 3 are inserted in the container body 1, and the top portion of each internal vessel 3 is connected with one external cap 2 by screw-thread MI.

A large volume infusion liquid 9 is filled into the container body 1. A sterile pharmaceutical powder 8A and another sterile pharmaceutical powder 8B are filled into respective one of said two internal vessels 3.

A difference between two corresponding industrial automatic filling production lines used in pharmaceutical field is as follows: for filling a large volume infusion liquid T9, Steps T1-T12 are carried out; for filling the sterile powder 8A into the first internal vessel 3, Steps T13-T20 are carried out. According to the requirements of GMP, if the sterile powders 8A and 8B can be filled into the container separately by the same production line, then before the sterile powder 8B is filled into the second internal vessel 3, the same filling production line which is used for the sterile powder 8A filled into the first internal vessel 3 must be cleaned, and the field is cleared, then according to Steps T13-T20, this production line is used to fill the sterile pharmaceutical powder 8B. That is, after the sterile powder 8A is filled into the first vessel 3 according to the process, a second sterile powder will be filled using the same production line, after necessary cleaning and field clear-up steps are carried out according to requirements of GMP. According to the requirements of GMP, if the sterile pharmaceutical powders 8A and 8B can not be filled into the container separately using one and the same production line, a second set of Steps T13-T20 shall be added for the second sterile powder 8B, that is, for two internal vessels to carry out Steps T13-T20, the sterile powders 8A and 8B are filled separately on two production lines. Thereafter, labeling and packing T21 will be performed.

Embodiment 4

Figure 7:
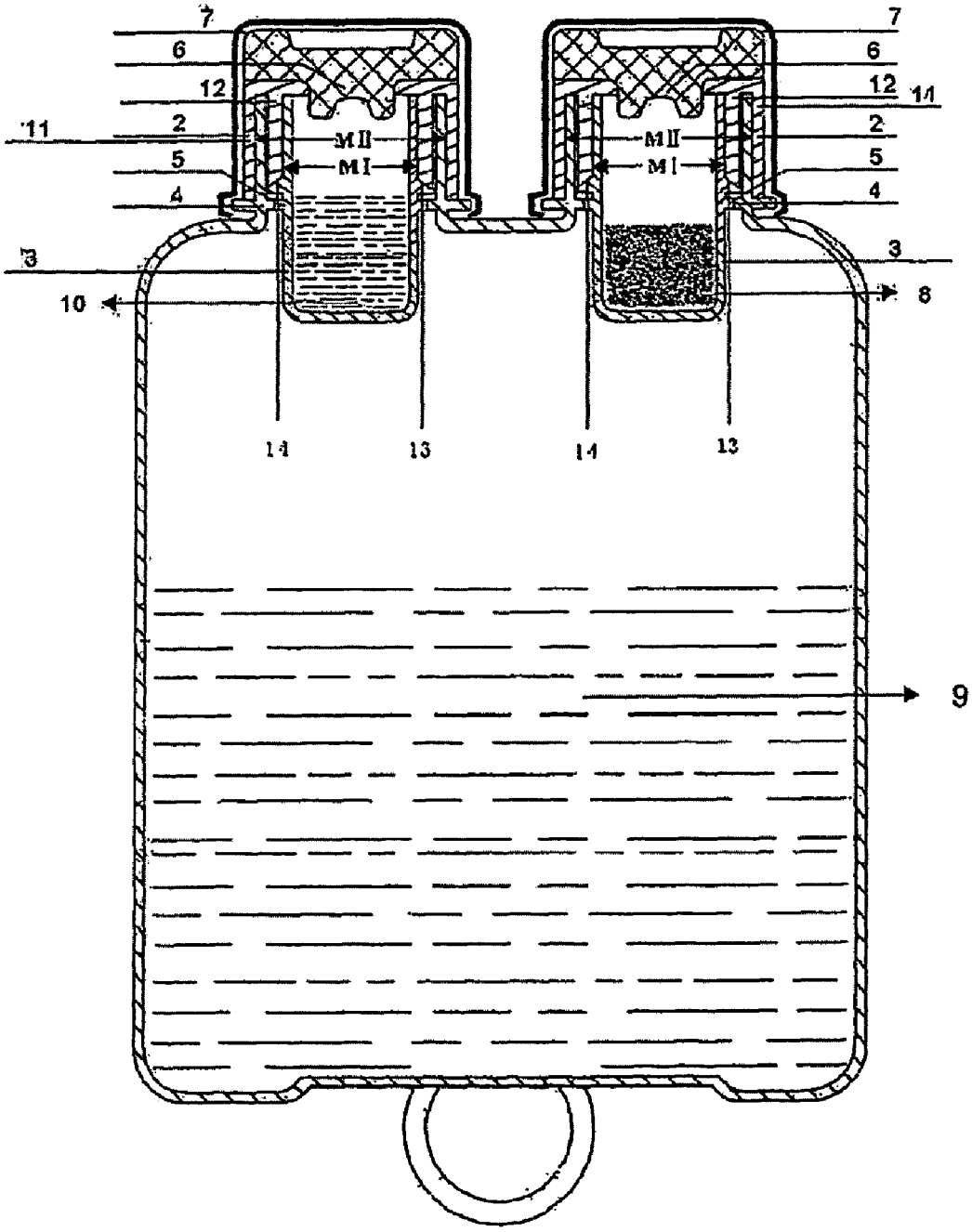
FIG. 7 is a schematic view showing the structure of a self-mixing container with a releasable internal vessel used for separately packing a sterile powder and a sterile liquid and a large volume liquid for infusion, wherein one internal vessel containing a sterile powder and one internal vessel containing a sterile liquid are integrated in one self-mixing container.

This embodiment relates to the usage of a self-mixing container with a releasable internal vessel in pharmaceutical field. (c.f. FIG. 3, FIG. 4 and FIG. 7)

A difference between this embodiment and Embodiment 3 resides in that a large volume infusion liquid 9 is filled into the container body 1, and a sterile pharmaceutical powder 8 and a sterile pharmaceutical liquid 10 are filled into respective one of two internal vessels 3.

A difference between two corresponding industrial automatic filling production lines used in the medical field is as follows: for filling a large volume infusion liquid 9, Steps T1-T12 are carried out; for filling the sterile pharmaceutical powder 8 into a first internal vessel 3, Steps T13-T20 are carried out. For filling the sterile pharmaceutical liquid 10 into a second internal vessel 3, a second set of steps T13-T20 shall be added for filling such sterile liquid, that is, for two internal vessels, the sterile powder 8 and the sterile liquid 10 shall be filled in sequence on two production lines T13-T20. Thereafter, labeling and packing T21 will be performed.

As drying technology for the internal vessel T14, sterilized heated-air is used for the sterile liquid, and the vacuum lyophilization technology is adopted for the sterile powder.

Embodiment 5

Figure 8:
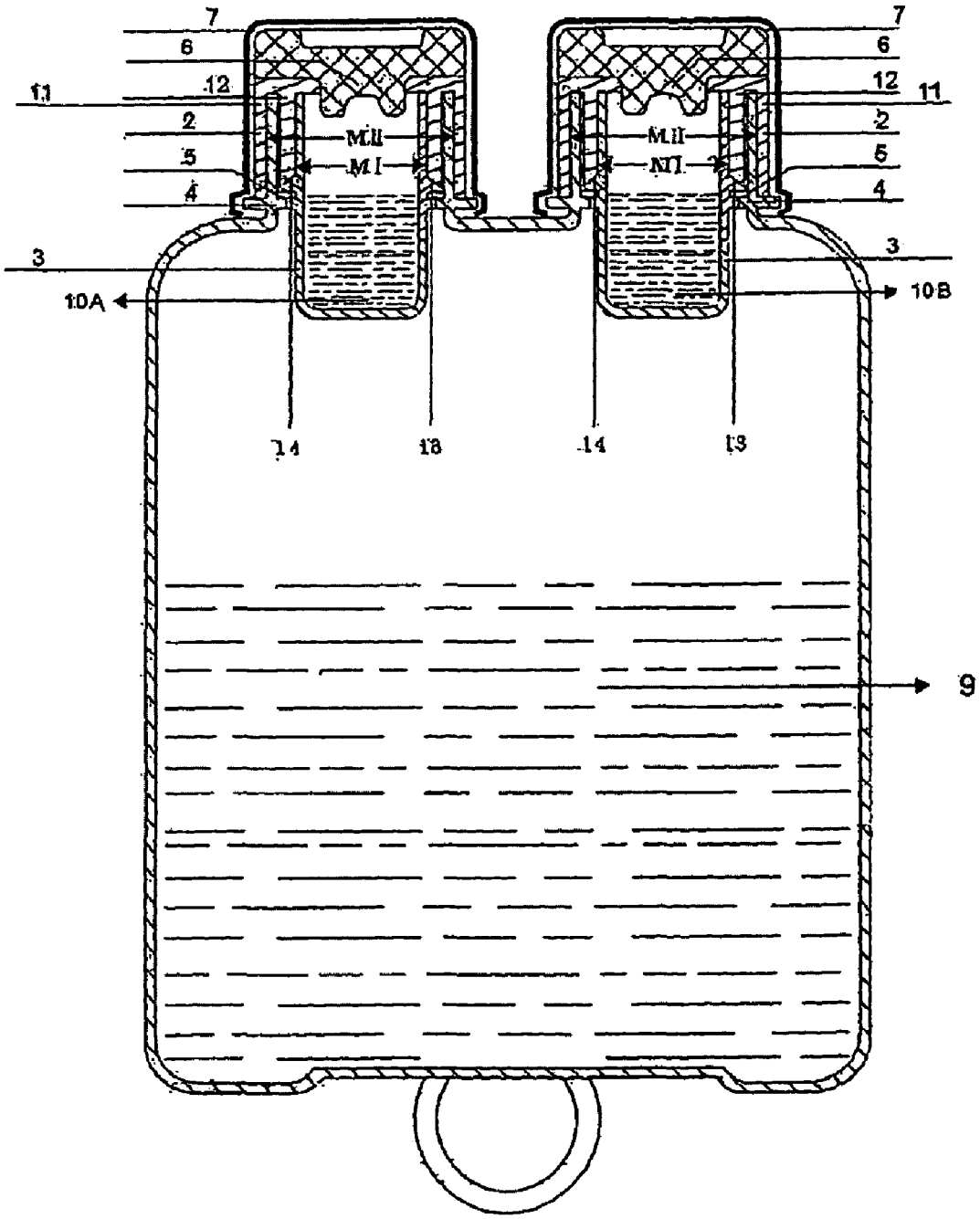
FIG. 8 is a schematic view showing the structure of a self-mixing container with a releasable internal vessel used for separately packing two sterile liquids and a large volume liquid for infusion, wherein two internal vessels containing different liquid pharmaceuticals are integrated in one self-mixing container.

This embodiment relates to the usage of a self-mixing container with a releasable internal vessel in pharmaceutical field. (c.f. FIG. 3, FIG. 4 and FIG. 8)

A difference between this embodiment and Embodiment 3 resides in that two sterile pharmaceutical liquids 10 are filled into two internal vessels 3 separately.

A large volume infusion liquid 9 is filled into the container body 1. A sterile pharmaceutical liquid 10A and another sterile liquid 10B are filled into respective one of two internal vessels 3.

A difference between two corresponding industrial automatic filling production lines used in pharmaceutical field is as follows: for filling a large volume infusion liquid T9, Steps T1-T12 are carried out; for filling the sterile liquid 10A into a first internal vessel 3, Steps T13-T20 are carried out. According to requirements GMP, if the sterile liquids 10A and 10B can be filled into the container separately via one and the same production line, then before the sterile liquid 10B is filled into the second internal vessel 3, said filling production line which is used for the sterile liquid 10A filled into the first internal vessel 3 must be cleaned, and the field is cleared up, then according to Steps T13-T20, this production line is used for filling the sterile liquid 10B. That is, after the sterile liquid 10A is filled into the first vessel 3 according to the process, filling a second sterile liquid can be realized using said production line, and if necessary, cleaning and field clearing-up steps are carried out according to requirements of GMP. According to requirements of GMP, if the sterile pharmaceutical liquids 10A and 10B can not be filled into the container separately by one and the same production line, a second set of Steps T13-T20 shall be added for filling the sterile liquid 10B, that is, for two internal vessels, the sterile liquid 10A and the sterile liquid 10B are filled separately on two production lines T13-T20. Thereafter, labeling and packing T21 will be carried out.

Sterilized heated-air technology is carried out on line for drying internal vessel T14, with quality requirements for the sterile pharmaceutical liquid 10 being met.

Embodiment 6

Figure 9:
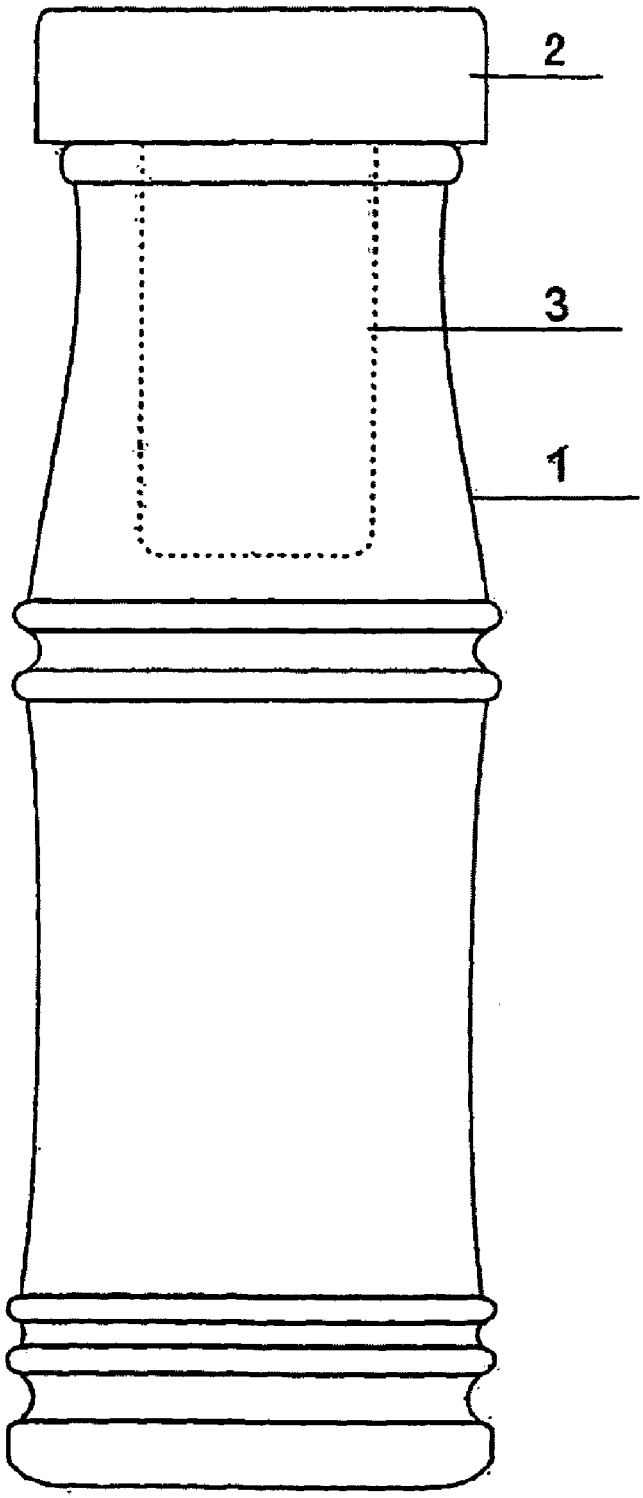
FIG. 9 is a schematic view showing the structure of a self-mixing container with a releasable internal vessel for food and beverage.

This embodiment relates to the usage of a self-mixing container with a releasable internal vessel in food and beverage field. (c.f. FIG. 1, FIG. 2 and FIG. 9)

As shown in FIG. 9, when the invention is applied in food and beverage field (functional beverages), drinkable mineral water, pure water or distilled water is filled into the container body 1. In the internal vessel 3 is contained a nutriment solution or a beneficial bacterium, wherein the nutriment solution is functional botanical extract (powder), honey, honey vinegar or honey paste. In use, when the external cap 2 is unscrewed, the internal vessel 3 will drop into the container body 1 automatically, so that self-mixing of the functional beverage is completed.

Embodiment 7

Figure 10:
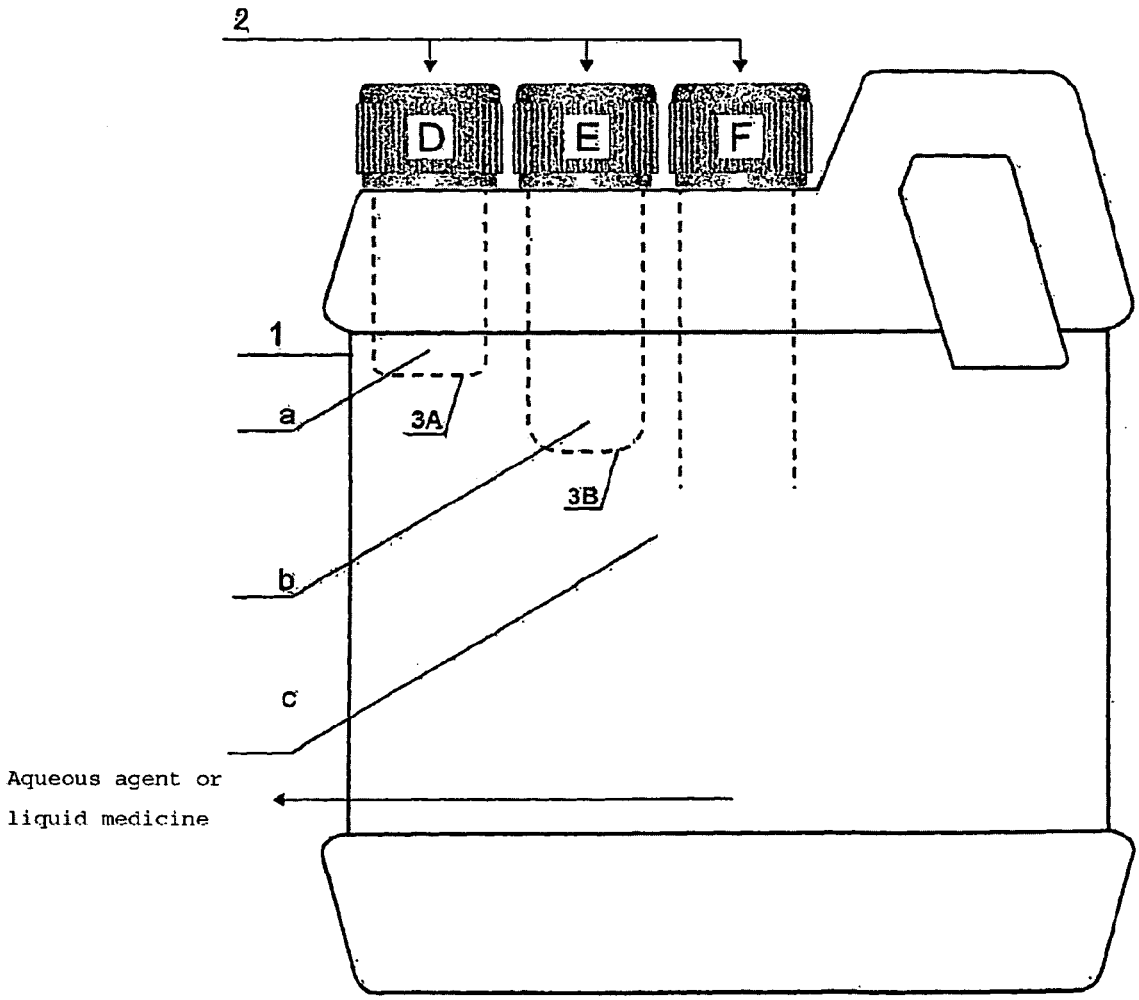
FIG. 10 is a schematic view showing the structure of a self-mixing container with a releasable internal vessel for disinfectants and farm chemicals, wherein three internal vessels are integrated in one self-mixing container.

This embodiment relates to the usage of a self-mixing container with a releasable internal vessel in disinfectants field and farm chemical field. (c.f. FIG. 1, FIG. 2 and FIG. 10)

As shown in FIG. 10, when the invention is applied in self-mixing and quick formulating disinfectants or farm chemicals, the invention can be embodied so that one or more external caps 2 are screwed onto a container body 1 from the outside, and correspondingly, one or more internal vessels 3 are installed therein, so as to realize the activation and fast formulating of two or more materials in one container body 1, (two internal vessels are integrated in one container, three in one, or four in one . . . ).

When the self-mixing container with a releasable internal vessel is used for disinfectants (or pesticides), a solution or ordinary water is filled into the container body 1, another active component a,b,c . . . is contained in respective internal vessels 3 A,B,C . . . either in powder form, or in liquid form. In use, the external caps 2 D,E,F . . . will be rotated in sequence, so that respective internal vessels 3 drop into the container body 1 automatically, and self-mixing and speedy formulation will be achieved.

Embodiment 8

Figure 11:
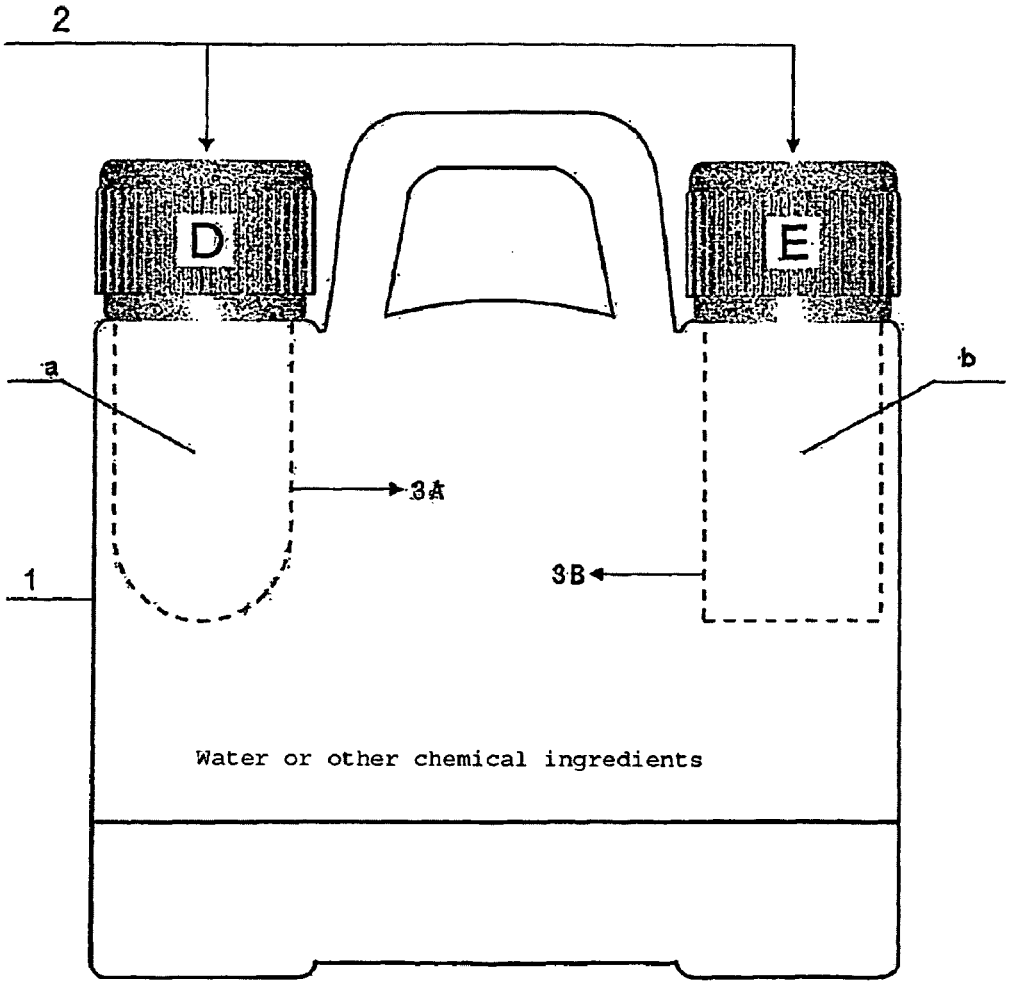
FIG. 11 is a schematic view showing the structure of a self-mixing container with a releasable internal vessel for chemical products or detergents, wherein two internal vessels are integrated in one self-mixing container.

This embodiment relates to the usage of a self-mixing container with a releasable internal vessel in chemical and detergent fields. (c.f. FIG. 1, FIG. 2 and FIG. 11)

As shown in FIG. 11, when the invention is realized as a self-mixing container with a releasable internal vessel for chemical products and detergents, water or other chemicals will be filled into the container body 1, and other chemical products (active components, catalysts) a,b, . . . , either in powder form or in liquid form, will be contained in respective internal vessels 3 A,B . . . . In use, when respective external caps 2 D,E, . . . are rotated, respective internal vessels 3 will drop into the container body 1 automatically, and self-mixing and speedy formulating will be achieved.

It is appreciated that a skilled person in the art would recognize many modifications, changes or substitutions for the above mentioned embodiments without departing from the spirit of the invention. It is, therefore, to be understood that the invention shall not be limited to the concrete embodiments disclosed therein, and is intended to cover all the modifications and/or changes falling within the scope of the invention as defined by the appended claims.

What is claimed is:

1. A self-mixing container with a releasable internal vessel, comprising a container body (1), an external cap (2) and an internal vessel (3), wherein different kinds of materials are contained in the container body (1) and the internal vessel (3) separately, and said external cap (2) comprises a cap inner wall (12) and a cap outer wall (11), characterized in that, wherein a ratchet (5) is provided on a suitable position on the outer wall of the internal vessel (3), and a plurality of pawls (4) are provided on a position corresponding to the ratchet (5) on an inner wall of a mouth-neck portion of the container body (1), wherein an inwardly oblique surface (13), which faces inwardly with respect to a center portion of the cap, is formed on a lower end face of the cap inner wall (12), an outwardly oblique surface (14), which faces outwardly with respect to the center portion of the cap, is formed in a corresponding position above the ratchet (5) and below a lip of the internal vessel (3) on the internal vessel (3), wherein the internal vessel (3) is abutted tightly against and connected with the external cap (2) by screwing on a first screw-thread (MI) between an upper portion of an outer wall of the internal vessel (3) and the cap inner wall (12), so as to form an assembly by the internal vessel (3) and the external cap (2), and when the internal vessel (3) is abutted tightly against and connected with the external cap (2) by screwing on the first screw-thread (MI), the inwardly oblique surface (13) is abutted tightly against the outwardly oblique surface (14) to enhance sealing performance, and wherein a second screw-thread (MII) having a same screwing direction as the first screw-thread is provided on the cap outer wall (11) for abutting against and connecting to a mouth of the container body (1), and wherein said positions of the ratchet and the pawls are configured such that the internal vessel (3) is prevented from rotating with the external cap due to engagement of the ratchet (5) with the pawls (4) when the external cap (2) is unscrewed from the mouth of the container body (1) through the second screw-thread (MII), after the assembly is inserted in to the mouth of the container body (1) and the external cap (2) is screwed on, thereby unscrewing the internal vessel (3) from the external cap (2) through the first screw-thread (MI) and thus separating outwardly oblique surface (14) on the internal vessel (3) from the inwardly oblique surface (13) on the low end face of the external cap (2) with the internal vessel (3) dropped into the container body (1) via gravity.

2. The self-mixing container with a releasable internal vessel according to claim 1, wherein the ratchet (5) is provided at a position below the screw thread (MI) on the outer wall of the internal vessel (3).

3. The self-mixing container with a releasable internal vessel according to claim 1, wherein when the external cap (2) is unscrewed, the internal vessel (3) and the cap inner wall (12) pass a stroke of the first screw-thread (MI) therebetween, simultaneously with the external cap (2) passing a stroke of the second screw-thread (MII) on the container body mouth.

4. The self-mixing container with a releasable internal vessel according to claim 1, wherein the materials contained in the container body (1) and the internal vessel (3) are gas, liquid or solid materials.

5. The self-mixing container with a releasable internal vessel according to claim 1, wherein at least one external cap (2) is provided on any portion of the container body of the self-mixing container with a releasable internal vessel, and one internal vessel (3) is provided for each of the external caps (2).

6. The self-mixing container with a releasable internal vessel according to claim 1, wherein the external cap (2) and the mouth of the container body (1) have a round cross section.

7. The self-mixing container with a releasable internal vessel according to claim 1, wherein the container body (1) is made from a polymer material, a metal material or a glass material, and the internal vessel (3) is made of a polymer material.

8. The self-mixing container with a releasable internal vessel according to claim 7, wherein the container body (1) is made from polypropylene or polyethylene, and the internal vessel (3) is made from polypropylene or polyethylene.

9. The self-mixing container with a releasable internal vessel according to claim 1, wherein the external cap (2) is hollow at its top central portion, through which the internal vessel (3) is filled, and the external cap (2) has a rubber stopper (6) for sealing the hollow central portion.

10. The self-mixing container with a releasable internal vessel according to claim 9, wherein the external cap (2) and the rubber stopper (6) are packed and sealed as a whole, via foils (7) or plastics having weaken points or lines.

11. The self-mixing container with a releasable internal vessel according to claim 1, wherein liquid is contained in the container body (1), while liquid or solid pharmaceuticals are contained in the internal vessel (3).

12. The self-mixing container with a releasable internal vessel according to claim 1, wherein drinkable mineral water, pure water or distilled water is contained in the container body (1), while a nutriment solution or a beneficial bacterium is contained in the internal vessel (3).

13. The self-mixing container with a releasable internal vessel according to claim 12, wherein said nutriment solution is functional botanical extract, honey, honey vinegar or honey paste.

14. The self-mixing container with a releasable internal vessel according to claim 1, wherein the internal vessel (3) has an outside annular protrusion, on which the outwardly oblique surface (14) is formed.

* * * * *